US009376937B2

(12) United States Patent
Goswami et al.

(10) Patent No.: US 9,376,937 B2
(45) Date of Patent: Jun. 28, 2016

(54) METHOD AND SYSTEM FOR GENERATING POWER FROM LOW- AND MID-TEMPERATURE HEAT SOURCES USING SUPERCRITICAL RANKINE CYCLES WITH ZEOTROPIC MIXTURES

(75) Inventors: D. Yogi Goswami, Tampa, FL (US); Huijuan Chen, Schenectady, NY (US); Elias Stefanakos, Tampa, FL (US)

(73) Assignee: University of South Florida, Tampa, FL (US)

( * ) Notice: Subject to any disclaimer, the term of this patent is extended or adjusted under 35 U.S.C. 154(b) by 0 days.

(21) Appl. No.: 13/591,792

(22) Filed: Aug. 22, 2012

(65) Prior Publication Data

US 2013/0213040 A1 Aug. 22, 2013

Related U.S. Application Data

(63) Continuation of application No. PCT/US2011/025698, filed on Feb. 22, 2011.

(60) Provisional application No. 61/306,780, filed on Feb. 22, 2010.

(51) Int. Cl.

| | |
|---|---|
| ***F01K 7/32*** | (2006.01) |
| ***F01K 25/06*** | (2006.01) |
| ***F01K 7/22*** | (2006.01) |
| ***F01K 9/00*** | (2006.01) |
| ***F01K 13/00*** | (2006.01) |
| ***F01K 25/08*** | (2006.01) |

(52) U.S. Cl.

CPC ... *F01K 7/32* (2013.01); *F01K 7/22* (2013.01); *F01K 9/003* (2013.01); *F01K 13/00* (2013.01); *F01K 25/06* (2013.01); *F01K 25/08* (2013.01)

(58) Field of Classification Search

CPC ..... F01K 25/00–25/14; F01K 7/32
USPC ..... 60/643–681
See application file for complete search history.

(56) References Cited

U.S. PATENT DOCUMENTS 1,632,575 A 6/1927 Abendroth
3,237,403 A 3/1966 Feher (Continued)

FOREIGN PATENT DOCUMENTS

JP 2001330692 A 11/2001

OTHER PUBLICATIONS

Huijuan Chen, D. Yogi Goswami, Muhammad M. Rahman, Elias K. Stefanakos, A supercritical Rankine cycle using zeotropic mixture working fluids for the conversion of low-grade heat into power, Energy, 2010, pp. 1-7.

(Continued)

*Primary Examiner* — Thomas Denion
*Assistant Examiner* — Laert Dounis
(74) *Attorney, Agent, or Firm* — David Hendricks; Nilay J. Choksi; Smith & Hopen, P.A.

(57) ABSTRACT

A method and system for generating power from low- and mid-temperature heat sources using a zeotropic mixture as a working fluid. The zeotropic mixture working fluid is compressed to pressures above critical and heated to a supercritical state. The zeotropic mixture working fluid is then expanded to extract power. The zeotropic mixture working fluid is then condensed, subcooled, and collected for recirculation and recompression.

32 Claims, 5 Drawing Sheets

(56) References Cited

U.S. PATENT DOCUMENTS

| | | | | |
|---|---|---|---|---|
| 3,683,621 | A | 8/1972 | Szewalski | |
| 3,971,211 | A | 7/1976 | Wethe et al. | |
| 4,142,108 | A | 2/1979 | Matthews | |
| 4,358,930 | A | 11/1982 | Pope et al. | |
| 4,422,297 | A * | 12/1983 | Rojey | 60/651 |
| 4,448,025 | A * | 5/1984 | Oda | F01K 25/06 252/67 |
| 4,498,289 | A | 2/1985 | Osgerby | |
| 4,557,112 | A | 12/1985 | Smith | |
| 4,785,876 | A * | 11/1988 | Sumitomo et al. | 165/111 |
| 4,827,877 | A * | 5/1989 | Sumitomo et al. | 122/34 |
| 5,557,936 | A * | 9/1996 | Drnevich | 60/649 |
| 6,070,420 | A | 6/2000 | Biancardi et al. | |
| 6,397,600 | B1 | 6/2002 | Romanelli | |
| 6,751,959 | B1 * | 6/2004 | McClanahan et al. | 60/670 |
| 6,964,168 | B1 | 11/2005 | Pierson et al. | |
| 7,007,474 | B1 | 3/2006 | Ochs et al. | |
| 7,493,763 | B2 * | 2/2009 | Klochko et al. | 60/641.7 |
| 2003/0029169 | A1 * | 2/2003 | Hanna et al. | 60/651 |
| 2009/0090111 | A1 | 4/2009 | Tomlinson et al. | |
| 2009/0107144 | A1 | 4/2009 | Moghtaderi et al. | |
| 2009/0173337 | A1 | 7/2009 | Tamaura et al. | |
| 2010/0154419 | A1 * | 6/2010 | Kontomaris | 60/645 |
| 2010/0251729 | A1 * | 10/2010 | Gutierrez et al. | 60/781 |
| 2010/0300093 | A1 * | 12/2010 | Doty | 60/641.2 |
| 2010/0327606 | A1 * | 12/2010 | Andrews | 290/1 R |
| 2013/0174552 | A1 * | 7/2013 | Mahmoud et al. | 60/671 |

OTHER PUBLICATIONS

Karellas et al., Supercritical Fluid Parameters in Organic Rankine Cycle Applications, Int. J. of Thermodynamics, 2008, vol. 11, No. 3, pp. 101-108.

Bliem et al., Advanced Binary Geothermal Power Plants Limits of Performance, U.S. Department of Energy, Jan. 1991, pp. 1-46.

X.D. Wang, L. Zhao, Analysis of zeotropic mixtures used in low-temperature solar Rankine cycles for power generation, Solar Energy, 2009, vol. 83, pp. 605-613.

Aleksandra Borsukiewicz-Gozdur, Wladyslaw Nowak, Comparative analysis of natural and synthetic refrigerants in application to low temperature Clausius—Rankine cycle, Energy, 2007, vol. 32, pp. 344-352.

Chen et al., A review of thermodynamic cycles and working fluids for the conversion of low-grade heat, Renewable and Sustainable Energy Reviews, 2010, vol. 14, pp. 3059-3067.

Chen et al., Converting Low-Grade Heat Into Power Using a Supercritical Rankine Cycle With Zeotropic Mixture Working Fluid, Proceedings ASME 2010 4th International Conference on Energy Sustainability, May 17-22, 2010, Phoenix, Arizona, USA.

International Search Report for International application No. PCT/US2011/025698, dated Nov. 9, 2011.

* cited by examiner

METHOD AND SYSTEM FOR GENERATING POWER FROM LOW- AND MID-TEMPERATURE HEAT SOURCES USING SUPERCRITICAL RANKINE CYCLES WITH ZEOTROPIC MIXTURES

CROSS REFERENCE TO RELATED APPLICATION

This application is a continuation of and claims priority to International Patent Application No. PCT/US2011/025698, entitled "Method and System for Generating Power from Low- and Mid-Temperature Heat Sources," filed on Feb. 22, 2011 which is a non-provisional of and claims priority to U.S. provisional patent application No. 61/306,780, entitled "Method and system for generation power from low- and mid-temperature heat sources," filed on Feb. 22, 2010, the contents of which are hereby incorporated by reference.

BACKGROUND OF THE INVENTION

1. Field of the Invention

The present invention relates to a method and system for generating power from low- and mid-temperature heat sources using a zeotropic mixture as a working fluid.

2. Description of the Related Art

The world is struggling to meet its energy demand and the extensive consumption of fossil fuels has increased concerns regarding the emission of greenhouse gases. Vast amounts of industrial waste heat, as well as renewable energies like solar, thermal, and geothermal have not been efficiently utilized because of their low energy density and low conversion efficiency. When gas, liquids, or solids that contain heat are discharged into the environment, not only is the energy wasted, it puts the environment in potential jeopardy. For this reason, different methods and processes for converting the aforesaid energy into usable forms are under study.

One option of utilizing low- and mid-temperature heat is to convert it into power. The traditional steam Rankine cycle is economical only when it is applied to the conversion of heat with temperatures higher than around 588K (600 F) or where there is a large overall heat content. In order to obtain greater compatibility with the low- and mid-temperature heat source streams, various organic working fluids as well as ammonia and carbon dioxide are suggested as a substitute to water (steam).

Both organic Rankine cycle and supercritical Rankine cycle have been proposed. In a supercritical Rankine cycle, instead of passing though the two phase region with a boiling system like in an organic Rankine cycle, a working fluid is heated directly from the liquid state into the supercritical state, which allows it to have a better thermal matching with the heat source than an organic Rankine cycle. Furthermore, a boiling system requires specialized equipment to separate the vapor phase from the liquid phase, and the supercritical Rankine cycle system has the potential of simplifying the cycle by omitting the boiling system. The concept of the supercritical Rankine cycle and the advantage of using supercritical conditions have been recognized for a long time. For example, U.S. Pat. No. 1,632,575 to Abendroth describes a system for generating power from supercritical steam. A combined supercritical steam cycle system is proposed in U.S. patent application Ser. No. 11/905,846 to Tomlinson et al. U.S. Pat. No. 3,683,621 to Szewalski discloses a method of improving the power cycle efficiency of a steam turbine for supercritical steam conditions. A supercritical cycle is also discussed in U.S. Pat. No. 4,142,108 to Matthews for geothermal energy conversion.

As much as the supercritical Rankine cycle is superior to a conventional Rankine cycle in many aspects, supercritical steam Rankine cycle cannot be used for the conversion of low- and mid-temperature heat due to its high critical temperature. The working fluid of a supercritical Rankine cycle is the key factor deciding its application and performance. Only a few working fluids have been proposed to be used in a supercritical Rankine cycle for low- and mid-temperature heat conversion. In U.S. Pat. No. 6,751,959 B1 to T. S. McClanahan, a single-stage supercritical Rankine cycle using ammonia as the working fluid is discussed. Carbon dioxide used as the working fluid in supercritical Rankine cycles is discussed in a number of patents (U.S. Pat. No. 3,971,211 to Wethe; U.S. Pat. No. 3,237,403 to Feher; U.S. Pat. No. 4,498,289 to Osgerby). U.S. Pat. No. 4,358,930 to Pope, claims a method of optimizing the performance of Rankine cycle power plants using supercritical hydrocarbon (or mixture of hydrocarbons) as the working fluid. U.S. Pat. No. 7,007,474 B1 to Ochs discusses a method of recovering energy from a supercritical fluid by inclemently expanding the supercritical fluid entering at least one of the expansion engines with a low quality heat source.

Outside of patent literature, a 2008 paper [Sotirios Karellas and Andreas Schuster, "Supercritical Fluid Parameters in Organic Rankine Cycle Applications", Int. J. Thermodynamics—Vol. 11, No. 3, 2008, pp. 101-108] compares a supercritical Rankine cycle with a normal organic Rankine cycle using the same working fluids (R134a, R227ea, R236fa, R245fa) to find out that the total efficiency of the supercritical Rankine cycle is 10%-20% higher than that of the regular organic Rankine cycle. It was also described that "the investigation of supercritical parameters in ORC applications seems to bring promising results in decentralized energy production[.]"

SUMMARY OF INVENTION

The present invention is a method and system for converting low- and mid-temperature heat into power. A zeotropic mixture is used as a working fluid and is heated to a supercritical state by exchanging heat from a sensible heat source.

The method and system combines a supercritical Rankine cycle and a zeotropic mixture. Instead of passing through the two phase region during the heating process, the working fluid is heated directly from a liquid to a supercritical state, which improves the thermal matching between the sensible heat source and the working fluid. By using a zeotropic mixture as the working fluid, condensation happens with a thermal glide, which creates a better thermal match between the working fluid and the cooling agent. Moreover, instead of using both a boiler and a superheater, the working fluid is heated from a liquid to a supercritical state with one heat exchanger, which simplifies the cycle configuration. The method and system reduces irreversibility, improves the cycle efficiency, simplifies the cycle configuration, and reduces costs.

According to one aspect of the invention, a method of generating power from low- and mid-temperature heat sources includes the steps of:

pumping or compressing a liquid zeotropic mixture working fluid to a supercritical pressure, i.e., a pressure above the liquid's critical pressure;

heating the working fluid by an indirect heat exchanger against the heat source, wherein the heating results in the working fluid becoming supercritical to a sufficient degree to ensure it remains substantially in a vapor state throughout the following work expansion step;

expanding the supercritical working fluid in a turbine expander at substantially constant entropy; and condensing and subcooling the exhaust working fluid from the turbine expander by transferring heat to a cooling agent (e.g. water, air) to prepare the working fluid for a new cycle.

The steps are performed in a thermodynamic cycle in both the liquid and supercritical phases of the zeotropic mixture working fluid. The zeotropic mixture working fluid is used to reduce the irreversibility in the condensing and subcooling process.

In an embodiment, to improve the cycle efficiency, the expanding step may include a multi-stage expander to reheat the working fluid.

According to another aspect of the invention, a system for generating power from low- and mid-temperature heat sources includes:

a pump for compressing a liquid zeotropic mixture beyond its critical pressure;

a heat exchanger in communication with the pump and the heat source for exchanging heat between the zeotropic working fluid and the heat source to superheat the zeotropic mixture working fluid;

a turbine in communication with the heat exchanger for expanding the superheated zeotropic mixture working fluid, thereby exporting mechanical work;

a condenser in communication with the turbine for condensing and subcooling the zeotropic mixture working fluid; and a surge vessel in communication with the condenser and the pump for collecting the zeotropic mixture working fluid.

The system operates a thermodynamic cycle in both the liquid and supercritical phases of the zeotropic mixture working fluid. The zeotropic mixture working fluid is used to reduce the irreversibility in the condenser.

In an embodiment, to improve the cycle efficiency, the system includes a multi-stage expander to reheat the working fluid.

In an embodiment, the working fluid includes a zeotropic mixture of a fluid selected from Dichlorofluoromethane, Chlorodifluoromethane, Trifluoromethane, Difluoromethane, Fluoromethane, Hexafluoroethane, 2,2-Dichloro-1,1,1-trifluoroethane, 2-Chloro-1,1,1,2-tetrafluoroethane, Pentafluoroethane, 1,1,1,2-Tetrafluoroethane, 1,1-Dichloro-1-fluoroethane, 1-Chloro-1,1-difluoroethane, 1,1,1-Trifluoroethane, 1,1-Difluoroethane, Octafluoropropane, 1,1,1,2,3,3,3-Heptafluoropropane, 1,1,1,2,3,3-Hexafluoropropane, 1,1,2,2,3-Pentafluoropropane, 1,1,1,3,3-Pentafluoropropane, Octafluorocyclobutane, Decafluorobutane and Dodecafluoropentane and others to cope with heat source temperature ranges from below 353K (176 F) to about 623K (662 F) and above. The fluids are best known as refrigerants by their ASHRAE number R-21, R-22, R-23, R-32, R-41, R-116, R-123, R-124, R-125, R-134a, R-141b, R-142b, R-143a, R-152a, R-218, R-227ea, R-236ea, R-245ca, R-245fa, R-C318, R-3-1-10 and FC-4-1-12, respectively. Unlike the highly ozone-depleting chlorofluorocarbons (CFCs), these fluids include one or more hydrogen atoms in the molecule, and, as a result, they can be largely destroyed in the lower atmosphere by naturally occurring hydroxyl radicals, ensuring that little or none of the fluid survives as it enters the stratosphere to destroy the ozone layer.

The aforementioned fluid mixtures are not exhaustive. It is envisioned that any fluid mixtures that include the required characteristics may be used in this invention.

Both single-stage and multiple-stage expansions are included in this invention. Although multiple-stage expansion has the drawbacks of increasing cost and operating complexity, the cycle efficiency may be significantly improved.

It is an object of the invention to provide a low cost, simple to operate, efficient, and compact method and system to improve and optimize the utilization of low- and mid-temperature heat to produce mechanical and/or electrical power.

Another object of the invention is to provide a method and system for optimizing the performance of a power plant system by adopting this invention as a bottoming cycle.

Yet another object of the invention is to permit the method and system to be located on one or more portable transportation means.

A further object of the invention is to permit the method and system to be designed and constructed according to a standardized set of specifications to a portable unit.

A still further object of the invention is to provide a method and system that can be operated automatically under normal or routine circumstances and needs minimum human intervention.

Another object of the invention is to convert energy such as solar, thermal, geothermal, and industrial waste heat into mechanical power efficiently.

Yet another object of the invention is to simplify the heating process of the working fluid against the heat source.

A further object of the invention is that it may be applied to rapidly provide electric power to a power transmission grid during peak or off-peak hours.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

The present invention and the practice includes using a zeotropic mixture working fluid in a supercritical cycle for the generation of power. The physical properties of the zeotropic mixture, and the simple configuration of the supercritical cycle, allows power to be produced from low- and mid-temperature heat sources more efficiently or from a relatively smaller volumetric flow. This invention enables many heretofore unused heat sources to be exploited for power generation.

The thermodynamic method and system for converting low- and mid-temperature heat into power includes:

means to pump a working fluid in a liquid phase into a pressure that surpasses a supercritical pressure to some extent;

means for transferring heat from a heat source to the working fluid such that the working fluid reaches a supercritical state;

means for expending the supercritical working fluid and converting the expansion work of the working fluid to mechanical power;

means for re-heating the working fluid exited from a turbine expansion if it is a two-stage expansion system;

means for expending the re-heated working fluid and converting the expansion work of the working fluid to mechanical power in the two-stage expansion system;

means for condensing and subcooling the working fluid after expanding by extracting heat from the working fluid; and means for returning the working fluid to the means for being pumped to a high pressure.

The heat source may include sensible heat from a gas, liquid, solid, solar, geothermal, waste heat or other heat source, or a mixture thereof.

The thermodynamic method and system for converting low- and mid-temperature heat into power further includes:

means for measuring the pressure and temperature of the working fluid after pumping the working fluid to a high pressure;

means for measuring the pressure and temperature of the working fluid after the heat exchanger against the heat source;

means for releasing the pressure after the heat exchanger;

means for measuring the temperature, pressure, and vapor fraction of the working fluid after expanding the working fluid in the turbine; and means for containing excess working fluid in the liquid state after cooling to condense the working fluid.

Figure 1:
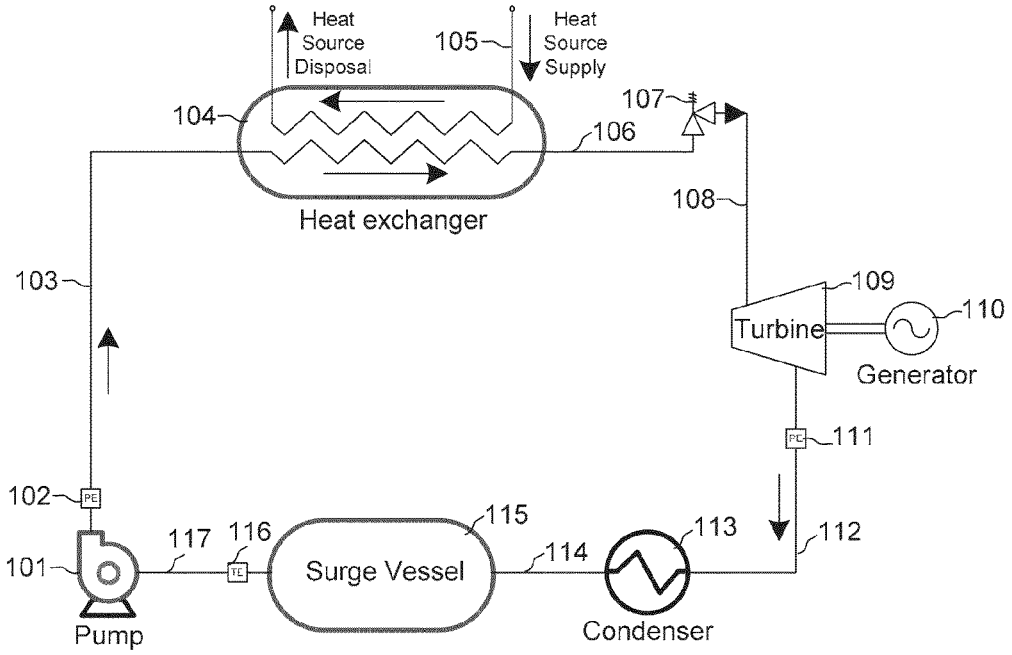
FIG. 1 is a schematic drawing of a single-stage-expansion cycle system.

A single-stage thermodynamic cycle is depicted in FIG. 1. The cycle includes pump 101, heat exchanger 104, expansion turbine 109 and generator 110, condenser 113, and surge vessel 115. A stream of the zeotropic mixture working fluid 117 is pumped to a pressure higher than the fluid's critical pressure by pump 101 to high pressured stream 103 and then heated isobarically to a supercritical vapor 106 through heat exchanger 104. The supercritical vapor 106 is expanded to drive the turbine. After expansion, fluid 112 is condensed in condenser 113 by dissipating heat to a cooling agent. Surge vessel 115 is placed after the condenser to accumulate the condensed zeotropic mixture working fluid 114. The condensed zeotropic mixture working fluid 117 is then pumped to high pressured fluid 103 again, which completes the cycle. Other than the cycle, meter 102 is mounted to measure the temperature and pressure of stream 103; meter 111 is mounted to measure the temperature and pressure of stream 112; and meter 116 is mounted to measure the temperature and pressure of stream 117. Pressure relief valve 107 is used to release the pressure in case stream 106 is over-compressed. Heat source 105 is a low- and mid-temperature heat source that counter flows against working fluid 103 in heat exchanger 104. Generator 110 is used to convert the mechanical work from turbine 109 into electrical power.

Figure 2:
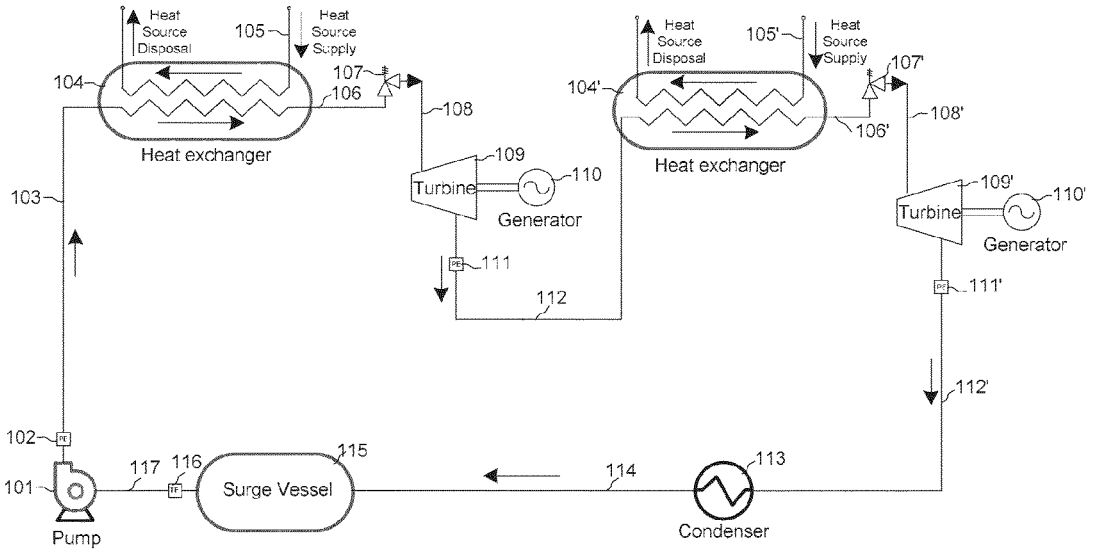
FIG. 2 is a schematic drawing of a two-stage-expansion cycle system.

FIG. 2 shares the same rationale as FIG. 1 except it has a two-stage expansion. Instead of being condensed directly, stream 112 is reheated through heat exchanger 104'. The resulting stream 106' is re-expanded in turbine 109' before it is condensed in condenser 113. Pressure relief valve 107', generator 110', and meter 111' serve the same functions as pressure relief valve 107, generator 110 and meter 111, respectively.

Figure 3:
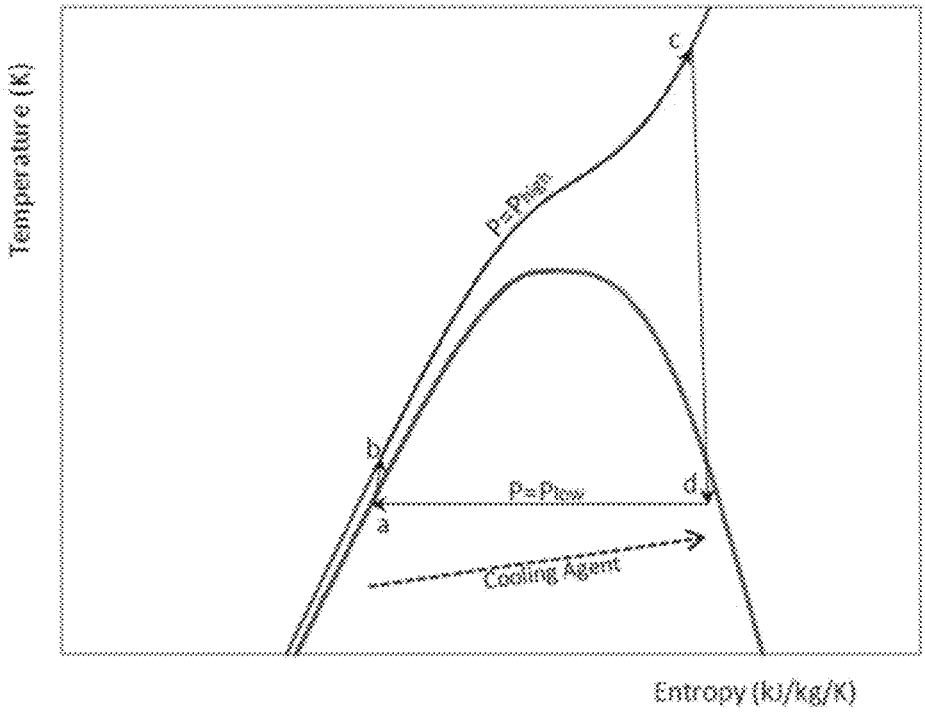
FIG. 3 is an Entropy vs. Temperature diagram showing the thermal matching of a pure working fluid with a cooling agent during the condensing process.
Figure 4:
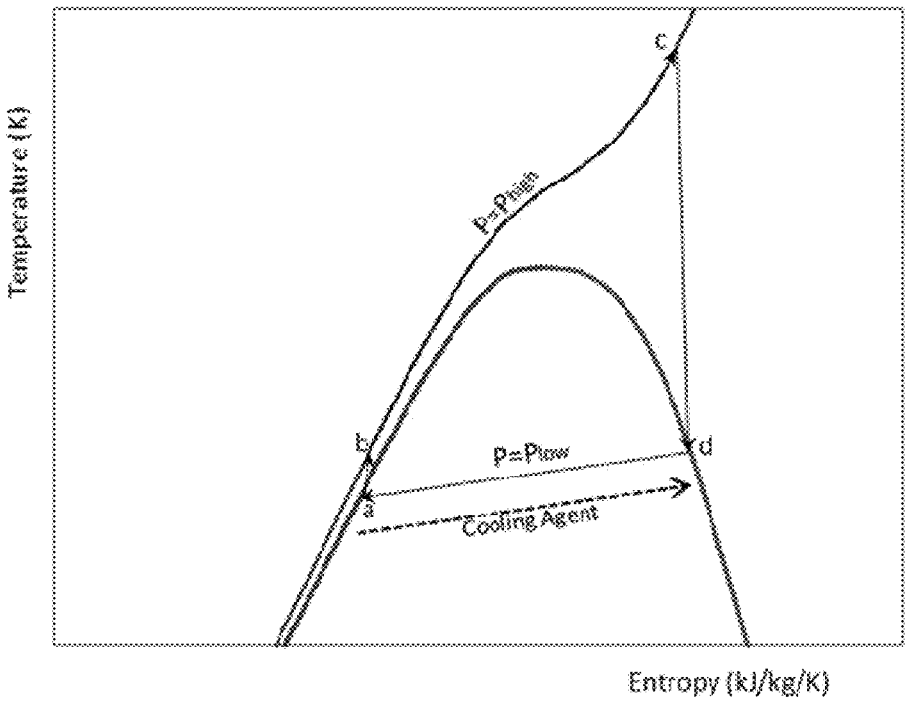
FIG. 4 is an Entropy vs. Temperature diagram showing the thermal matching of a zeotropic mixture working fluid with a cooling agent during the condensing process.

FIG. 3 and FIG. 4 compare a supercritical Rankine cycle using pure fluids and a cycle using a zeotropic mixture working fluid. In both cycles, a low-pressured working fluid in liquid phase is pumped to a pressure that surpasses its supercritical pressure to some extent (a→b). The resulting working fluid is heated to a supercritical state (b→c). The supercritical working fluid is then expanded to low pressure (c→d). Finally, the expanded working fluid is cooled and condensed by a cooling agent (d→a), which completes the cycle. The advantage of the zeotropic mixture working fluid is seen through comparing the condensing process (d→a) of both cycles. The zeotropic mixture working fluid creates a thermal glide during the isobaric condensation. In contrast, a pure working fluid condenses at constant temperature. The thermal glide created by the zeotropic mixture working fluid creates a better thermal match with the cooling agent (dashed line), which minimize the irreversibility and exergy loss.

Figure 5:
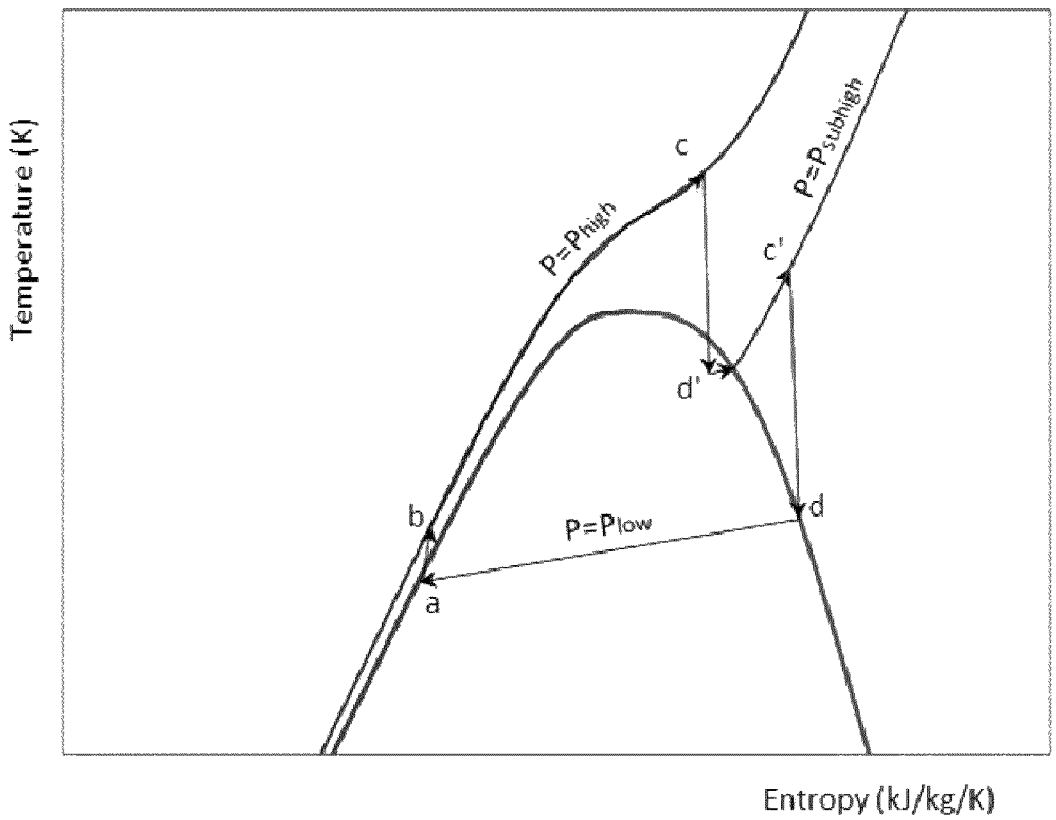
FIG. 5 is an Entropy vs. Temperature diagram showing the two-stage expansion.

FIG. 5 is a two-stage expansion demonstrated in a Temperature vs. Entropy diagram. Compared with a single-stage expansion as explained above, the expanded working fluid (state point d') is reheated to a high temperature (c') and then expanded for a second time (c'→d). The remaining processes are the same as those in single-stage expansion system.

Examples of the zeotropic mixtures include the following components: Dichlorofluoromethane, Chlorodifluoromethane, Trifluoromethane, Difluoromethane, Fluoromethane, Hexafluoroethane, 2,2-Dichloro-1,1,1-trifluoroethane, 2-Chloro-1,1,1,2-tetrafluoroethane, Pentafluoroethane, 1,1,1,2-Tetrafluoroethane, 1,1-Dichloro-1-fluoroethane, 1-Chloro-1,1-difluoroethane, 1,1,1-Trifluoroethane, 1,1-Difluoroethane, Octafluoropropane, 1,1,1,2,3,3,3-Heptafluoropropane, 1,1,1,2,3,3-Hexafluoropropane, 1,1,2,2,3-Pentafluoropropane, 1,1,1,3,3-Pentafluoropropane, Octafluorocyclobutane, Decafluorobutane and Dodecafluoropentane, or R-21, R-22, R-23, R-32, R-41, R-116, R-123, R-124, R-125, R-134a, R-141b, R-142b, R-143a, R-152a, R-218, R-227ea, R-236ea, R-245ca, R-245fa, R-C318, R-3-1-10 and FC-4-1-12, respectively by their ASHRAE number. The properties of the example fluids for the composition of zeotropic mixtures are listed in TABLE I.

TABLE I

| ASHRAE Number | Name | Molecular Weight | Critical Temperature (K) | Critical Pressure (MPa) |
|---|---|---|---|---|
| R-21 | Dichlorofluoromethane | 102.92 | 451.48 | 5.18 |
| R-22 | Chlorodifluoromethane | 86.47 | 369.30 | 4.99 |
| R-23 | Trifluoromethane | 70.01 | 299.29 | 4.83 |
| R-32 | Difluoromethane | 52.02 | 351.26 | 5.78 |
| R-41 | Fluoromethane | 34.03 | 317.28 | 5.90 |
| R-116 | Hexafluoroethane | 138.01 | 293.03 | 3.05 |
| R-123 | 2,2-Dichloro-1,1,1-trifluoroethane | 152.93 | 456.83 | 3.66 |
| R-124 | 2-Chloro-1,1,1,2-tetrafluoroethane | 136.48 | 395.43 | 3.62 |
| R-125 | Pentafluoroethane | 120.02 | 339.17 | 3.62 |
| R-134a | 1,1,1,2-Tetrafluoroethane | 102.03 | 374.21 | 4.06 |
| R-141b | 1,1-Dichloro-1-fluoroethane | 116.95 | 477.50 | 4.21 |
| R-142b | 1-Chloro-1,1-difluoroethane | 100.50 | 410.26 | 4.06 |
| R-143a | 1,1,1-Trifluoroethane | 84.04 | 345.86 | 3.76 |
| R-152a | 1,1-Difluoroethane | 66.05 | 386.41 | 4.52 |

TABLE I-continued

| ASHRAE Number | Name | Molecular Weight | Critical Temperature (K) | Critical Pressure (MPa) |
|---|---|---|---|---|
| R-218 | Octafluoropropane | 188.02 | 345.02 | 2.64 |
| R-227ea | 1,1,1,2,3,3,3-Heptafluoropropane | 170.03 | 375.95 | 3.00 |
| R-236ea | 1,1,1,2,3,3-Hexafluoropropane | 152.04 | 412.44 | 3.50 |
| R-245ca | 1,1,2,2,3-Pentafluoropropane | 134.05 | 447.57 | 3.93 |
| R-245fa | 1,1,1,3,3-Pentafluoropropane | 134.05 | 427.20 | 3.64 |
| R-C318 | Octafluorocyclobutane | 200.03 | 388.38 | 2.78 |
| R-3-1-10 | Decafluorobutane | 238.03 | 386.33 | 2.32 |
| FC-4-1-12 | Dodecafluoropentane | 288.03 | 420.56 | 2.05 |

The above list shows only examples. Any fluid mixtures that have the required characteristics may be used in this invention.

It is required that the composed zeotropic mixtures used as the working fluids of the present invention must have a thermal glide during an isobaric condensation process (that is, a change in the condensation temperature as the mixture continues to condense at a constant pressure).

Example Embodiment

In order that those skilled in the art may better understand the advantages of the present invention, the following example is given by way of illustration only and not necessarily by way of limitation. Numerous variations thereof will occur and will undoubtedly be made by those skilled in the art without substantially departing from the true and intended scope and spirit of the instant invention herein taught and disclosed.

This example illustrates the advantages of using a zeotropic mixture as a working fluid by comparing the exergetic efficiency of the heat exchanger between a pure fluid and a zeotropic mixture during the condensation process. The fluids of choice for comparison are pure 1,1,1,2-Tetrafluoroethane and a zeotropic mixture of difluoromethane and 1,1,1,2-Tetrafluoroethane (0.3/0.7 mass fraction). For the comparison, the following design and operating parameters are used for both working fluids:

Average condensing temperature: 309.46K (97.36 F);

Working fluid mass flow rate: 1 kg/s;

Heat exchanger pinch limitation: 8K (14.4 F); and

Cooling agent: water.

Figure 6:
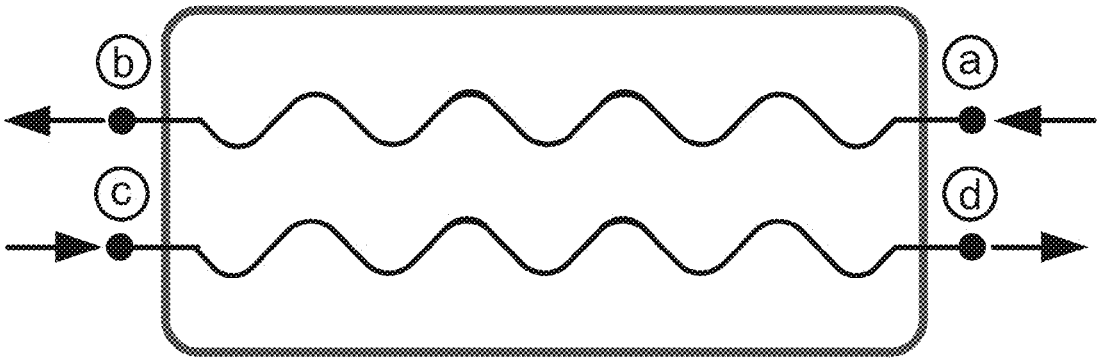
FIG. 6 is a schematic drawing of a heat exchanger for the condensing process.

A counter flow heat exchanger used for the condensation process is depicted in FIG. 6. The working fluid enters the heat exchanger as saturated vapor at point ⓐ and condensed to saturated liquid at point ⓑ. Water as a cooling agent enters the heat exchanger at point ⓒ and exits it at point ⓓ, during which process heat is extracted from the working fluid.

Figure 7:
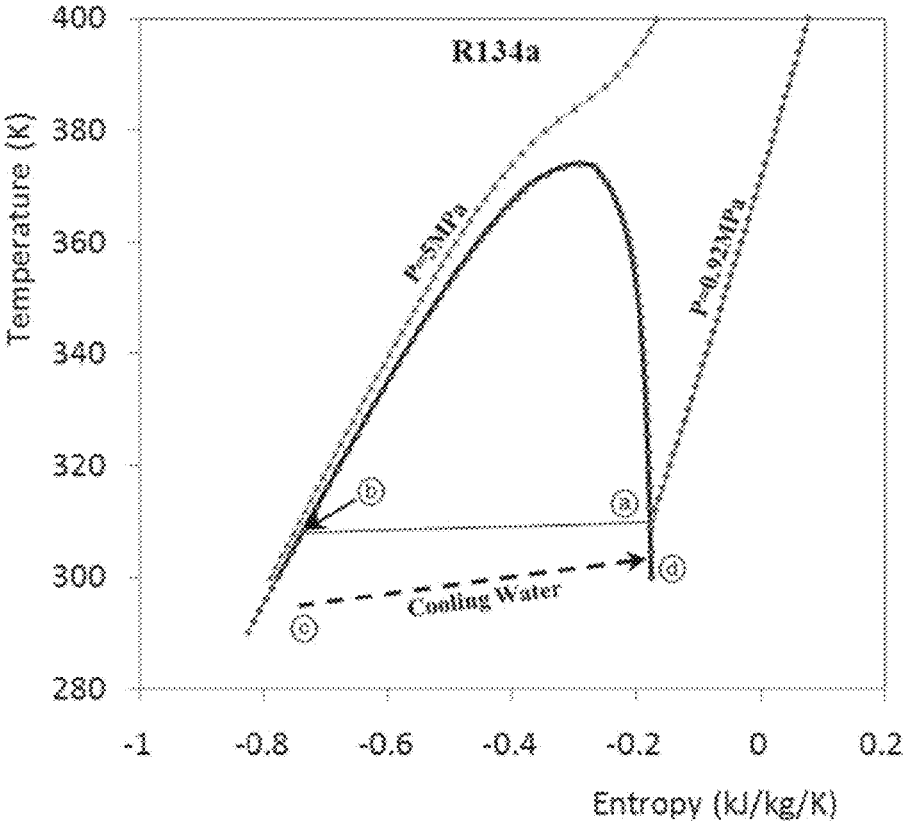
FIG. 7 is an Entropy vs. Temperature diagram of the pure working fluid R134a and its thermal matching with the cooling water.
Figure 8:
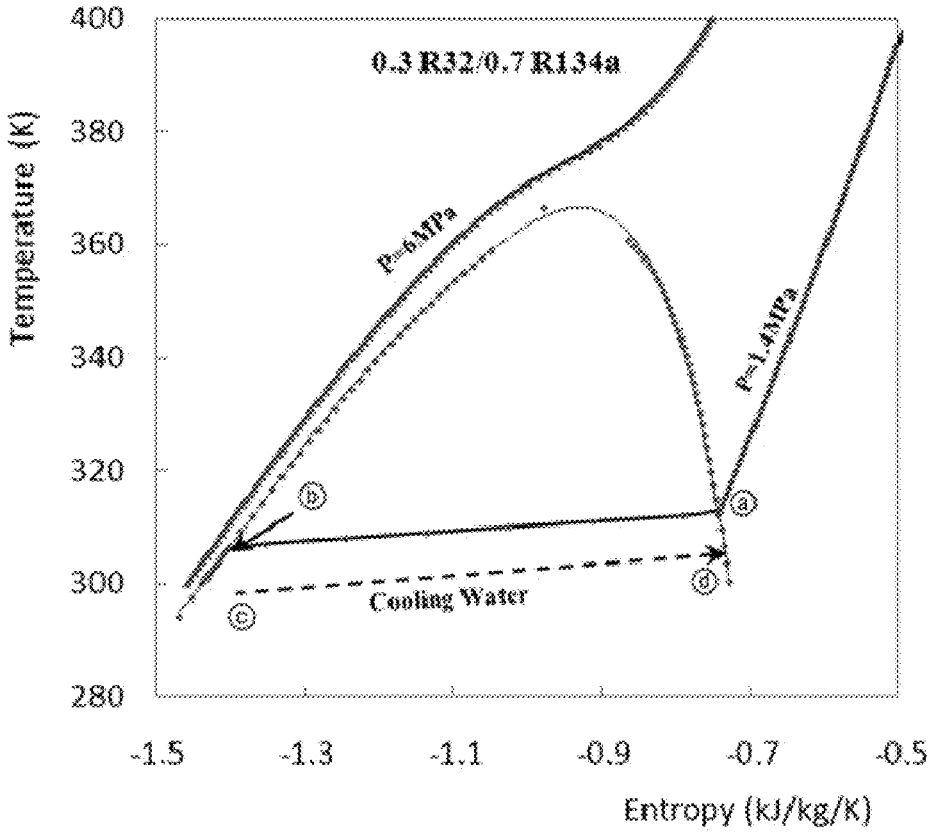
FIG. 8 is an Entropy vs. Temperature diagram of the zeotropic mixture (0.3 R32/0.7 R143a mass fraction) and its thermal matching with the cooling water.

The heat exchange processes are also demonstrated in the Temperature vs. Entropy diagrams in FIGS. 7 and 8 with pure 1,1,1,2-Tetrafluoroethane and a zeotropic mixture of difluoromethane and 1,1,1,2-Tetrafluoroethane (0.3/0.7 mass fraction), respectively.

As there is a thermal glide of the zeotropic mixture during the condensing process, the heat exchange process is designed such that the temperature profile of the cooling water parallels that of the working fluid so that a best thermal match is obtained. A calculation of the heat exchange during the condensing process of the zeotropic mixture of difluoromethane and 1,1,1,2-Tetrafluoroethane (0.3/0.7 mass fraction) is first carried out.

From the ChemCAD® process simulation software, the zeotropic mixture of difluoromethane and 1,1,1,2-Tetrafluoroethane (0.3/0.7 mass fraction) is condensed isobarically at 1.4 MPa in order to get an average condensing temperature of 309.46K (97.36 F), with a starting condensing temperature of 312.37K (102.59 F) at point ⓐ and an ending condensing temperature of 306.56 K (92.13 F) at point ⓑ, as depicted in FIG. 8.

With an 8K (14.4 F) pinch limitation between the heat exchanging fluids, the inlet and outlet temperatures of the cooling water are 298.56K (77.74 F) at point ⓒ and 304.36K (88.18 F) at point ⓓ.

The mass flow rate of the cooling water is 8.37 kg/s by reducing the mass and energy rate balance for the heat exchanging system at steady state. The exergetic heat exchanger efficiency is calculated through the exergy balance equation to be 81.64%.

With the same mass flow rate of cooling water and the aforesaid design and operating parameters, calculations of the condensing process of pure 1,1,1,2-Tetrafluoroethane are also conducted. A calculated result of the condensing processes of the pure 1,1,1,2-Tetrafluoroethane and the zeotropic mixture of difluoromethane and 1,1,1,2-Tetrafluoroethane (0.3/0.7 mass fraction) is listed in TABLE II.

TABLE II

| | Working Fluid Temperature | | Cooling Water Temperature | | |
|---|---|---|---|---|---|
| Working Fluid | Point ⓐ (K) | Point ⓑ (K) | Point ⓒ (K) | Point ⓓ (K) | Exergy Efficiency (%) |
| 1,1,1,2-Tetrafluoroethane | 309.46 | 309.46 | 293.73 | 301.46 | 66.55 |
| Zeotropic mixture* | 312.37 | 306.56 | 298.56 | 304.37 | 81.64 |

Note:
zeotropic mixture of difluoromethane and 1,1,1,2-Tetrafluoroethane (0.3/0.7 mass fraction)

From TABLE II, it is observed that the thermal glide of the zeotropic mixture is 312.37K−306.56K=5.81K (10.46 F). In contrast, there is no thermal glide created by pure 1,1,1,2-Tetrafluoroethane. The cooling water temperature required by pure 1,1,1,2-Tetrafluoroethane is 293.73K (69.04 F), which is 4.83K (8.68 F) lower than the zeotropic mixture. Exergy efficiency indicates the percentage of usable energy conserved during the condensing process. It is seen that the exergy efficiency of the zeotropic mixture is 22.67% ((81.64%−66.55%)/66.55%) higher than that of the pure fluid 1,1,1,2-Tetrafluoroethane.

It will thus be seen that the objects set forth above, and those made apparent from the foregoing disclosure, are efficiently attained. Since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein disclosed, and all statements of the scope of the invention that, as a matter of language, might be said to fall therebetween.

What is claimed is:

1. A system for generating power from a low- and mid-temperature heat source using a zeotropic mixture working fluid within a closed-loop supercritical Rankine cycle, comprising:

a pump for compressing said zeotropic mixture working fluid beyond its critical pressure, said zeotropic mixture working fluid having one critical curve and isobaric boiling curve;

a first heat exchanger in communication with said pump and said heat source for exchanging heat between said zeotropic mixture working fluid and said heat source, said zeotropic mixture working fluid being superheated to a supercritical state;

a first turbine in communication with said heat exchanger for expanding said superheated zeotropic mixture working fluid for exporting mechanical work;

a first generator in communication with said first turbine for converting said work to power;

a condenser in communication with said first turbine for condensing and subcooling said zeotropic mixture working fluid, said condenser having a cooling agent, said zeotropic mixture working fluid having a thermal glide during isobaric condensation such that said thermal glide of said zeotropic mixture working fluid substantially matches a temperature profile of said cooling agent to minimize irreversibility and exergy loss; and a surge vessel in communication with said condenser and said pump for collecting said zeotropic mixture working fluid for recirculation and recompression.

2. A system for generating power as in claim 1, further comprising:

a second heat exchanger in communication with said first turbine and said heat source for exchanging heat between said zeotropic mixture working fluid and said heat source, said zeotropic mixture working fluid being superheated to a supercritical state;

a second turbine in communication with said second heat exchanger for expanding said superheated zeotropic mixture working fluid for exporting mechanical work; and a second generator in communication with said second turbine for converting said work to power.

3. A system for generating power as in claim 1, wherein said heat source has a temperature below 600K (620.33° F.).

4. A system for generating power as in claim 1, wherein said heat source includes sensible heat.

5. A system for generating power as in claim 1, wherein said pump has a high efficiency so that vaporization of said zeotropic mixture working fluid does not occur after said zeotropic mixture working fluid is pumped.

6. A system for generating power as in claim 1, wherein said zeotropic mixture working fluid includes organic fluids and carbon dioxide.

7. A system for generating power as in claim 1, wherein said zeotropic mixture is a mixture of components selected from fluids including Dichlorofluoromethane, Chlorodifluoromethane, Trifluoromethane, Difluoromethane, Fluoromethane, Hexafluoroethane, 2,2-Dichloro-1,1,1-trifluoroethane, 2-Chloro-1,1,1,2-tetrafluoroethane, Pentafluoroethane, 1,1,1,2-Tetrafluoroethane, 1,1-Dichloro-1-fluoroethane, 1-Chloro-1,1-difluoroethane, 1,1,1-Trifluoroethane, 1,1-Difluoroethane, Octafluoropropane, 1,1,1,2,3,3,3-Heptafluoropropane, 1,1,1,2,3,3-Hexafluoropropane, 1,1,2,2,3-Pentafluoropropane, 1,1,1,3,3-Pentafluoropropane, Octafluorocyclobutane, Decafluorobutane, Dodecafluoropentane, and carbon dioxide, or R-21, R-22, R-23, R-32, R-41, R-116, R-123, R-124, R-125, R-134a, R-141b, R-142b, R-143a, R-152a, R-218, R-227ea, R-236ea, R-245ca, R-245fa, R-C318, R-3-1-10, FC-4-1-12 and R-744 by their by their ASHRAE number, respectively.

8. A system for generating power as in claim 1, wherein said first heat exchanger is a counterflow heat exchanger.

9. A system for generating power as in claim 1, wherein said first heat exchanger is insulated and includes a total heat loss less than 5%.

10. A system for generating power as in claim 2, wherein said second heat exchanger is a counterflow heat exchanger.

11. A system for generating power as in claim 2, wherein said second heat exchanger is insulated and includes a total heat loss less than 5%.

12. A system for generating power as in claim 1, wherein said cooling agent includes air, water, soil, or a combination thereof.

13. A system for generating power as in claim 1, further comprising:

a valve for measuring and controlling a flow rate of said zeotropic mixture working fluid within said system.

14. A system for generating power as in claim 1, further comprising:

a meter for measuring the temperature of said zeotropic mixture within said system; and a valve for controlling a flow rate of said zeotropic mixture working fluid within said system, whereby heat transfer between said zeotropic mixture working fluid and said heat source can be controlled, thus allowing the temperature of said zeotropic mixture working fluid to be controlled and measured.

15. A system for generating power as in claim 1, further comprising:

a valve for measuring, controlling, or relieving the pressure of said zeotropic mixture working within said system.

16. A method of generating power from a low- and mid-temperature heat source using a zeotropic mixture working fluid within a closed-loop supercritical Rankine cycle, comprising the steps of:

compressing said zeotropic mixture working fluid beyond its critical pressure, said zeotropic mixture working fluid having one critical curve and one isobaric boiling curve;

exchanging heat between said zeotropic mixture working fluid and said heat source, said zeotropic mixture working fluid being superheated to a supercritical state;

expanding said superheated zeotropic mixture working fluid for exporting mechanical work;

converting said work to power;

condensing and subcooling said zeotropic mixture working fluid via a cooling agent, said zeotropic mixture working fluid having a thermal glide during isobaric condensation such that said thermal glide of said zeotropic mixture working fluid substantially matches a temperature profile of said cooling agent to minimize irreversibility and exergy loss; and collecting said zeotropic mixture working fluid for recirculation and recompression.

17. A method of generating power as in claim 16, further comprising the steps of:

exchanging heat between said zeotropic mixture working fluid and said heat source a second time, said zeotropic mixture working fluid being superheated to a supercritical state;

expanding said superheated zeotropic mixture working fluid for exporting mechanical work a second time; and converting said work to power a second time.

18. A method of generating power as in claim 16, wherein said heat source has a temperature below 600K (620.33 F).

19. A method of generating power as in claim 16, wherein said heat source includes sensible heat.

20. A method of generating power as in claim 16, wherein said zeotropic mixture working fluid includes organic fluids.

21. A method of generating power as in claim 16, wherein said heat source includes heat from a gas, liquid, solid, or combination thereof.

22. A method of generating power as in claim 16, wherein said heat source includes heat from solar radiation, geothermal heat, ocean, waste heat or a combination thereof.

23. A method of generating power as in claim 16, wherein said zeotropic mixture is a mixture of components selected from working fluids including Dichlorofluoromethane, Chlorodifluoromethane, Trifluoromethane, Difluoromethane, Fluoromethane, Hexafluoroethane, 2,2-Dichloro-1,1,1-trifluoroethane, 2-Chloro-1,1,1,2-tetrafluoroethane, Pentafluoroethane, 1,1,1,2-Tetrafluoroethane, 1,1-Dichloro-1-fluoroethane, 1-Chloro-1,1-difluoroethane, 1,1,1-Trifluoroethane, 1,1-Difluoroethane, Octafluoropropane, 1,1,1,2,3,3,3-Heptafluoropropane, 1,1,1,2,3,3-Hexafluoropropane, 1,1,2,2,3-Pentafluoropropane, 1,1,1,3,3-Pentafluoropropane, Octafluorocyclobutane, Decafluorobutane, Dodecafluoropentane, and carbon dioxide, or R-21, R-22, R-23, R-32, R-41, R-116, R-123, R-124, R-125, R-134a, R-141b, R-142b, R-143a, R-152a, R-218, R-227ea, R-236ea, R-245ca, R-245fa, R-C318, R-3-1-10, FC-4-1-12 and R-744 by their ASHRAE number, respectively.

24. A method of generating power as in claim 16, wherein different zeotropic mixtures are composed and selected for different operating conditions to maximize a thermal glide matching during said heat transfer.

25. A method of generating power as in claim 16, wherein said zeotropic mixture does not involve any chemical reactions among the mixture components.

26. A method of generating power as in claim 16, wherein said zeotropic mixture is composed of inorganic fluids and organic fluids.

27. A system of generating power as in claim 1, wherein said heat source has a temperature greater than 600K.

28. A system of generating power as in claim 27, wherein said zeotropic mixture is a mixture of working fluids, wherein at least one of said working fluids has a critical temperature lower than 600K.

29. A method of generating power as in claim 16, wherein said heat source has a temperature greater than 600K.

30. A method of generating power as in claim 29, wherein said zeotropic mixture is a mixture of working fluids, wherein at least one of said working fluids has a critical temperature lower than 600K.

31. A system of generating power as in claim 1, wherein said zeotropic mixture working fluid is a mixture of difluoromethane and 1,1,1,2-Tetrafluoroethane (0.3/0.7 mass fraction).

32. A method of generating power as in claim 16, wherein said zeotropic mixture working fluid is a mixture of difluoromethane and 1,1,1,2-Tetrafluoroethane (0.3/0.7 mass fraction).

* * * * *